US008033787B1

(12) United States Patent
Miller et al.

(10) Patent No.: US 8,033,787 B1
(45) Date of Patent: Oct. 11, 2011

(54) CANOPY COVER FOR A CEILING FAN

(75) Inventors: Michael D. R. Miller, Fort Worth, TX (US); John F. Mares, Coppell, TX (US)

(73) Assignee: Litex Industries, Limited, Grand Prairie, TX (US)

( * ) Notice: Subject to any disclaimer, the term of this patent is extended or adjusted under 35 U.S.C. 154(b) by 756 days.

(21) Appl. No.: 12/215,524

(22) Filed: Jun. 27, 2008

(51) Int. Cl.
*F01D 5/08* (2006.01)

(52) U.S. Cl. ..... 416/5; 416/146 R; 416/214 R; 416/244 R; 416/246

(58) Field of Classification Search ..... 416/5, 146 R, 416/155, 170 R, 21 R, 244 R, 246
See application file for complete search history.

(56) References Cited

U.S. PATENT DOCUMENTS

| | | | | |
|---|---|---|---|---|
| 4,548,554 | A * | 10/1985 | Angott | 417/572 |
| 4,621,977 | A * | 11/1986 | Markwardt | 416/5 |
| 4,878,806 | A | 11/1989 | Markwardt | |
| RE34,147 | E * | 12/1992 | Rezek | 416/5 |
| 5,340,277 | A * | 8/1994 | Whitaker | 416/5 |
| 5,613,832 | A | 3/1997 | Su | |
| 5,658,129 | A * | 8/1997 | Pearce | 416/5 |
| 5,845,886 | A * | 12/1998 | McCormick | 248/200.1 |
| 5,944,487 | A * | 8/1999 | Pearce | 416/244 R |
| 5,947,436 | A * | 9/1999 | Bucher et al. | 248/345 |
| 5,988,580 | A | 11/1999 | Bucher et al. | |
| 6,046,416 | A | 4/2000 | Bucher et al. | |
| D430,283 | S | 8/2000 | Wu | |
| 6,158,964 | A * | 12/2000 | Gajewski | 416/244 R |
| 6,171,060 | B1 * | 1/2001 | Gajewski | 416/244 R |
| 6,204,461 | B1 | 3/2001 | Bucher et al. | |
| 6,558,124 | B2 | 5/2003 | Bucher et al. | |
| 6,790,008 | B1 | 9/2004 | Huang | |
| 7,028,963 | B1 * | 4/2006 | Silva et al. | 248/342 |
| 7,249,744 | B2 | 7/2007 | Bacon et al. | |
| 7,261,520 | B2 | 8/2007 | Wang | |
| 7,785,077 | B2 * | 8/2010 | Richardson et al. | 416/244 R |
| 2001/0022937 | A1 * | 9/2001 | Bucher et al. | 416/244 R |
| 2003/0189151 | A1 | 10/2003 | Hsing | |
| 2004/0115062 | A1 * | 6/2004 | Pearce | 416/244 R |
| 2004/0191065 | A1 * | 9/2004 | Chen | 416/210 R |
| 2005/0006549 | A1 * | 1/2005 | Liu | 248/343 |
| 2006/0263224 | A1 * | 11/2006 | Wang | 416/244 R |
| 2008/0286105 | A1 * | 11/2008 | Gajewski et al. | 416/155 |
| 2008/0286111 | A1 * | 11/2008 | Richardson et al. | 416/244 R |

OTHER PUBLICATIONS

Harbor Breeze®, New Orleans/Ceiling Fan, SOS Item/Articulo #31904, Model/Modelo #NO52AB6LKC, Manual, 11 pages.

* cited by examiner

*Primary Examiner* — Michael Lebentritt
(74) *Attorney, Agent, or Firm* — Mark W Handley

(57) ABSTRACT

A ceiling fan (12) is suspended from a mounting bracket (40) by a down rod (32) and a canopy (42) is provided for concealing the mounting bracket (40). The canopy (42) has a lower end (52) with apertures (56, 58) for mounting the ceiling fan (12) directly to the canopy (42) in alternative mounting configurations. A cover (44) is provided for concealing the apertures (56, 58) in the canopy (42). The cover (44) has a collar (102) which extends through a down rod opening (54) in the canopy (42), and has a plurality of protuberances (104) which secure the cover (44) to the lower end (52) of the canopy (42) in a snap engagement. A lip portion (100) upwardly extends from the cover (44) to provide a spacer for locating the protuberances (104) adjacent to an upper side of the lower end (52) of the canopy (42).

20 Claims, 4 Drawing Sheets

CANOPY COVER FOR A CEILING FAN

TECHNICAL FIELD OF THE INVENTION

The present invention relates in general to ceiling fans, and in particular to ceiling mounting brackets and canopies for covering the ceiling fan mounting brackets.

BACKGROUND OF THE INVENTION

Prior art ceiling fans have been suspended from ceilings with mounting brackets which are fastened to a ceiling joists. Ceiling fans are often suspended beneath mounting brackets by down rods which extend from the mounting brackets to motor housings of the ceiling fans. Canopies are typically provided by sleeves which extend around the down rods and cover the mounting brackets, such that the mounting brackets are concealed from view to enhance the appearance of the ceiling fans. The canopies have been secured to mounting brackets by through-hole type threaded fasteners, such as screws, which extend through holes in the canopies and engage within threaded holes formed into the mounting brackets. In some circumstances, motor housings are secured directly to the canopies rather than to the down rods. For such embodiments, the canopies may have apertures for passing fasteners which secure the motor housings directly to the canopies. Ceiling fans are often packaged for sale with the mounting brackets, the canopies and the motor housings adapted for mounting the motor housings to either the down rods or directly to the canopies. This requires that the apertures for passing fasteners be formed in the lower ends of the canopies for use in configurations in which down rods are not used, which results in an unsightly appearance if left uncovered when the motor housings are mounted in down rod configurations.

SUMMARY OF THE INVENTION

A mounting bracket for securing a ceiling fan to a ceiling joist has two mounting arms and a support ring. The two mounting arms are disposed on opposite sides of the support ring and extend upward from the support ring. The mounting arms together include two oppositely disposed tabs for securing to the ceiling joist. The tabs have exteriorly disposed end portions into which threaded mounting holes are formed. A down rod extends from the support ring for suspending the motor housing beneath the mounting bracket. A canopy has a tapered body with an upwardly disposed rim portion, sidewalls, and a lower end preferably defined by a planar-shaped lower portion having a down rod opening formed therein. The canopy body extends around and conceals the mounting bracket from view beneath the ceiling fan. The rim portion of the canopy has mounting holes aligned for registering with the threaded mounting holes in the two mounting arms for receiving fasteners which secure the canopy to the mounting bracket. The lower portion of the canopy has mounting apertures for receiving fasteners which secure the motor housing directly to the canopy when the fan is mounted in a configuration in which a down rod is not used, and clearance apertures for receiving the heads of other fasteners secured in the motor housing. A cover is provided for concealing the lower end of the canopy through which apertures extend. The cover has a disc portion with a centrally disposed cover opening for extending around the down rod and registering with the down rod opening in the canopy. A collar upwardly extends from the disc portion, adjacent the cover opening, and is adapted for extending into the down rod opening in the canopy. Protuberances are defined by embosses formed into the collar to extend outward, opposite the cover opening, for engaging the portion of the lower end of the canopy which is adjacent to the down rod opening to secure the cover to the canopy. A lip upwardly extends from an outer edge of the disk portion of the canopy an engages an outer portion of the lower end of the canopy to vertically location the protuberances for fitting against the top side of the lower end of the canopy.

DESCRIPTION OF THE DRAWINGS

For a more complete understanding of the present invention and the advantages thereof, reference is now made to the following description taken in conjunction with the accompanying Drawings in which

FIG. 1 is a partially exploded, perspective view of a ceiling fan secured to a mounting bracket with a down rod, and shows a canopy for concealing the mounting bracket in a one-quarter longitudinal sectional view;

FIG. 2 is a partially exploded, perspective view of the mounting bracket and an upper portion of the down rod;

FIG. 3 is a perspective view of the mounting bracket, viewed from an opposite side than shown in FIG. 2;

FIG. 4 is a partially exploded, perspective view of the ceiling fan configured for mounting directly to the canopy, with the canopy shown in a one-quarter longitudinal sectional view;

FIG. 5 is a perspective view of a cover for a lower end the canopy; and

FIG. 6 is a perspective view of the ceiling fan secured to the mounting bracket with the down rod, with the canopy shown in a one-quarter longitudinal sectional view and a cover secured to the lower end of the canopy.

DETAILED DESCRIPTION OF THE INVENTION

Figure 1:
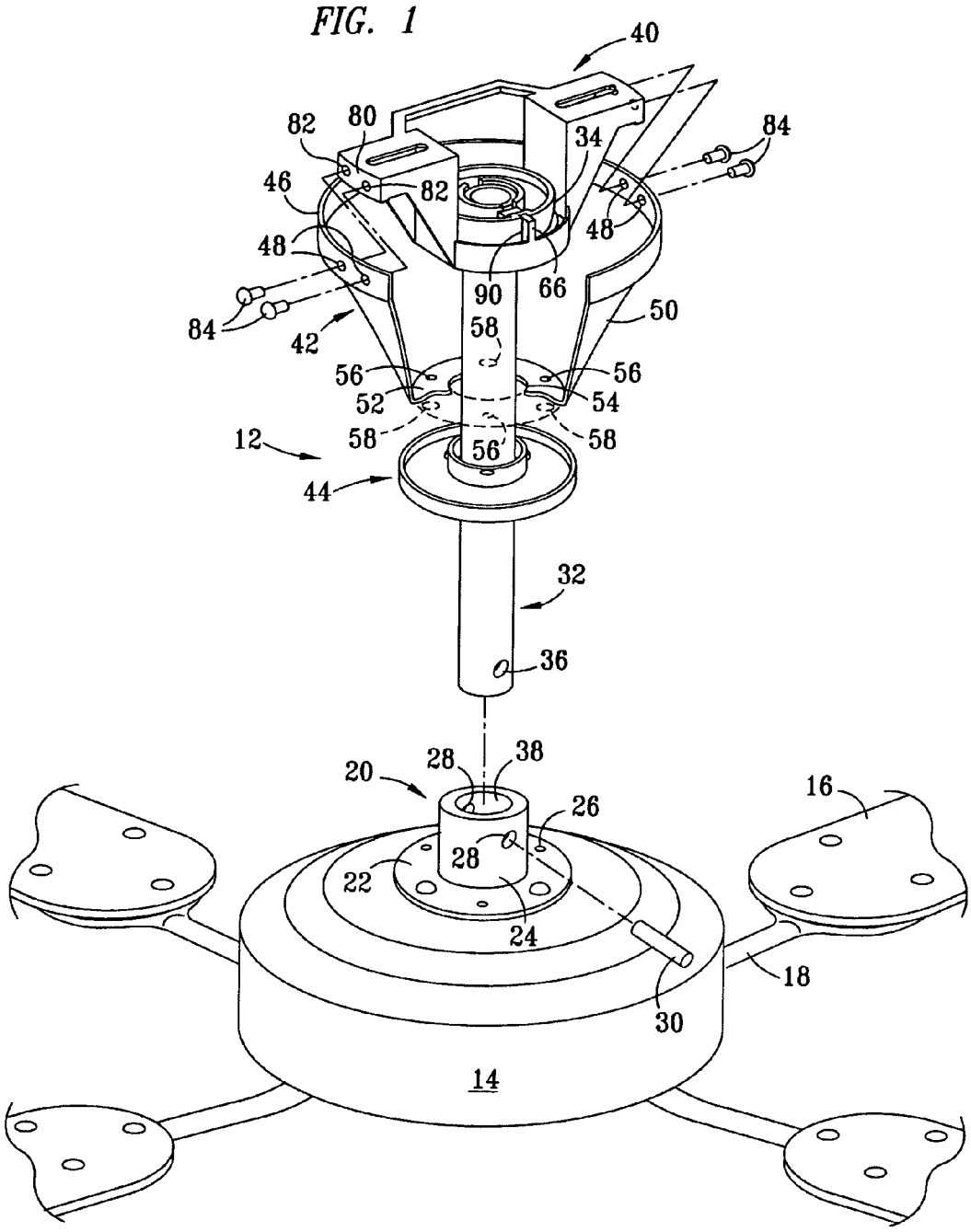
FIGS. 1 through 6 show various aspects of a cover for a canopy of a ceiling fan made according to the present invention, as set forth below.

Referring to the Figures, FIG. 1 is a partially exploded, perspective view of a ceiling fan 12 having a motor housing 14, fan blades 16 and fan blade brackets 18 for securing the fan blades 16 to the rotor portion of the motor in the motor housing 14. The stator portion of the motor is rigidly secured in the upper portion of the motor housing 14 and a mounting member 20. The mounting member 20 has a planar portion 22 and a yoke 24. Two aligned mounting holes 28 are provided for receiving a mounting pin 30 to secure a lower end of a down rod 32 in an opening 38 in the yoke 24 of the mounting member 20. The mounting pin 30 is preferably of the type having an aperture transverse to a longitudinal axis thereof for receiving a cotter pin to secure the mounting pin 30 in a fixed position within the mounting holes 28 of the yoke 24. The down rod 32 is preferably a cylindrical shaped, tubular member which extends between the yoke 24 and the mounting bracket 40. The upper end of the down rod 32 has a mounting boss 34 which fits within the mounting bracket 40 to suspend the motor housing 14 from a ceiling joist, or such. Two opposed apertures 36 extend in opposite sides of the lower end of the down rod 32 for aligning with the mounting holes 28 in the yoke 24 and receiving the mounting pin 30.

A canopy 42 is shown in one-quarter longitudinal sectional view, and extends around the down rod 32 and around the mounting bracket 40 to conceal the mounting bracket 40 from view. A cover 44 for concealing the lower end of the canopy 42 is also shown. The canopy 42 preferably has a tapered hollow body formed to have a rim portion 46, mounting holes 48 formed into the rim portion 46, a tapered sidewall 50, an a lower end 52. The lower end 52 preferably defines a planar-shaped lower portion for the canopy 42, defining an annular-shaped flange which extends orthogonal to a longitudinal axis of the down rod 32 and the ceiling fan 12. A down rod opening 54 extends through the lower end 52 for receiving the down rod 32. Preferably, three mounting holes 56 and three clearance holes 58 provide apertures which are formed into the lower end 52 of the canopy 42, spaced apart equal angular distances.

Figure 2:
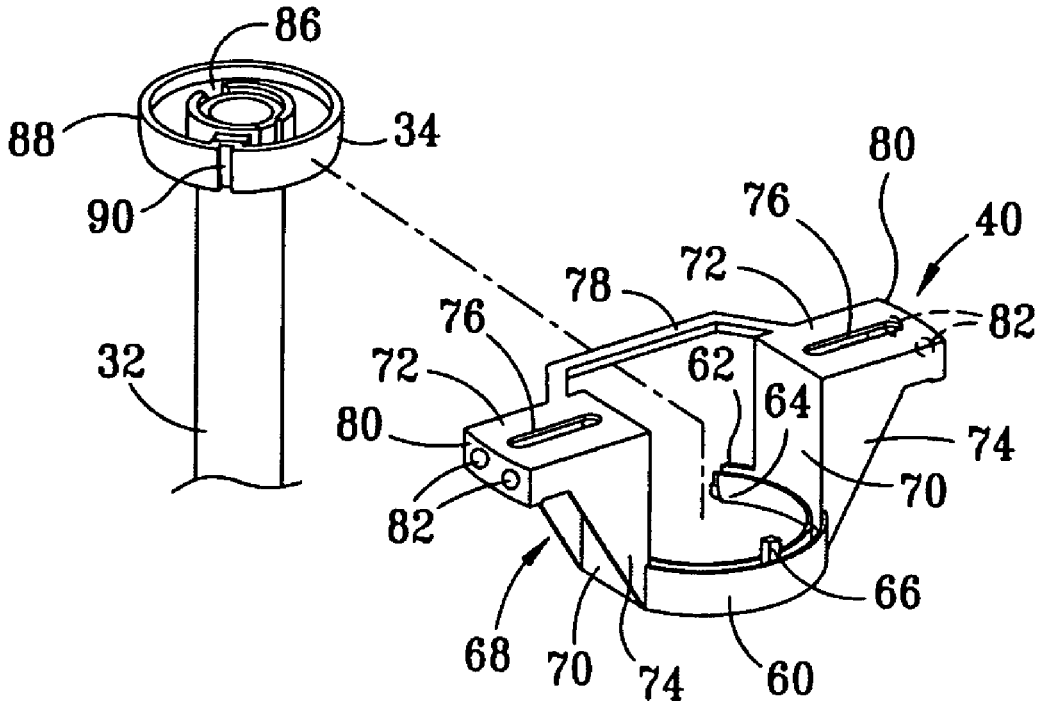

FIG. 2 is a partially exploded, perspective view of the mounting bracket 40 and an upper portion of the down rod 32. The mounting bracket 40 is preferably provided by a casting having a support ring 60, two mounting arms 68, and a support arm 78. The support ring 60 extends between the two mounting arms 68 to provide a support member. The support ring 60 is preferably an annular shaped ring which is not a continuous ring, but rather has two ends 62 defining an opening in the support ring 60 for passing the down rod 32 during assembly of the down rod 32 to the mounting bracket 40. The support ring 60 preferably has an interior surface 64 which is tapered to have circumferential diameters which are larger at the top and smaller at the bottom. The mounting boss 32 of the down rod 32 will nest within the support ring 60. A locating tab 66 extends from the support ring 60 for fitting in the slot 90 in the mounting boss 34 for angularly locating the mounting boss 34 of upper end of the down rod 32 with the mounting bracket 40. The two mounting arms 68 of the mounting bracket 40 preferably have vertical portions 70 and tab portions 72, each having planar surfaces. Gusset supports 74 extend between respective ones of the vertical portions 70 and tab portions 72, and also have planar surfaces. The upper surfaces of the tab portions 72 are flat and have slots 76 formed therein which provide mounting apertures for securing the mounting bracket 40 to a ceiling support member, such as a ceiling joist. The support arm 78 extends between the two mounting arms 68, adjacent to the upper surfaces of the tab portions 72. The outermost end portions of the tab portions 72 define the end face portions 80, which face in opposite directions. The upper end of the down rod 32 is secured within a yoke 86 of the mounting boss 32. The mounting boss 32 has an exterior surface 88 having a slot 90 for receiving the locating tab 66. The surface 88 is preferably tapered for fitting flush within the surface 64 of the support ring 60.

Figure 3:
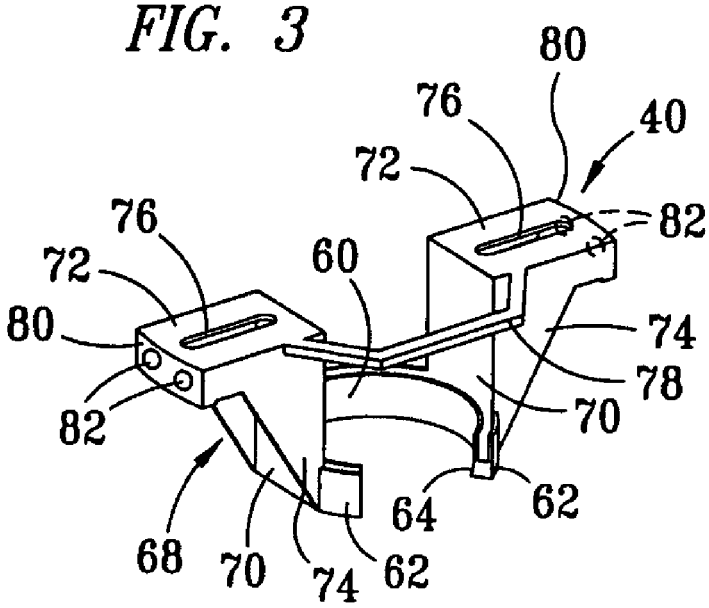

FIG. 3 is a perspective view of the mounting bracket 40, viewed from an opposite side to that shown in FIG. 2. The opening between the two ends 62 of the support ring 60 is more clearly shown. The two ends 62 are spaced apart and the down rod opening is sized for fitting the down rod 32 between the two ends 62, with the mounting boss 34 disposed between the support ring 60 and the support arm 78.

Figure 4:
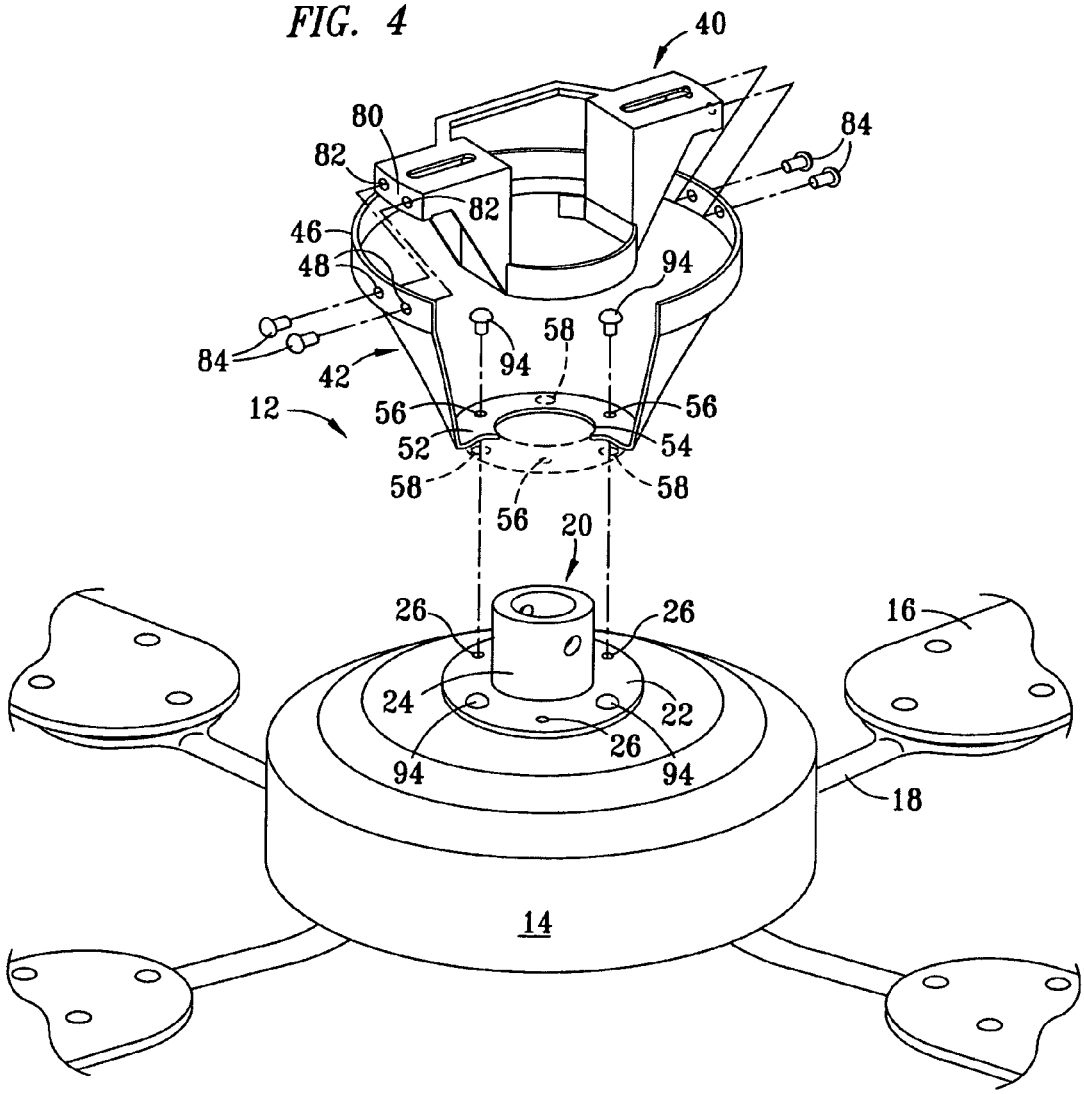

FIG. 4 is a partially exploded, perspective view of a ceiling fan 12 configured for mounting directly to the canopy 42, with the canopy 42 shown in a one-quarter longitudinal sectional view. The underside of the lower end 52 of the canopy 42 fits flush against the upperside of the planar mounting portion 22 of the mounting member 20. The canopy 42 is rigidly secured to the motor housing 14 by passing a portion, preferably a quantity of three, of the bolts 94 through the mounting holes 56 in the lower end 52 of the canopy 42 and into mounting holes 26 in the planar portion 22 of the mounting member 20. Preferably, the mounting holes 26 are threaded or have members with threaded holes disposed within the motor housing 14 with the threaded holes aligned adjacent the mounting holes 26 for receiving the bolts 94 which pass through the mounting holes 26. The down rod hole 54 in the canopy 42 provides clearance for passing the yoke 24 into the canopy 42. Clearance holes 58 are provided which are of larger size than the mounting holes 56 to provide clearance for passing the heads of the bolts 94 which remain secured in the motor housing 14. The rim portion 46 of the canopy 42 is disposed adjacent the end faces 80 for aligning the mounting holes 48 adjacent to the threaded mounting holes 82 for receiving the mounting screws 84 and securing the canopy 42 to the mounting bracket 40, with the ceiling fan fully supported by the canopy 41. In this configuration, the down rod 32 is not used.

Figure 5:
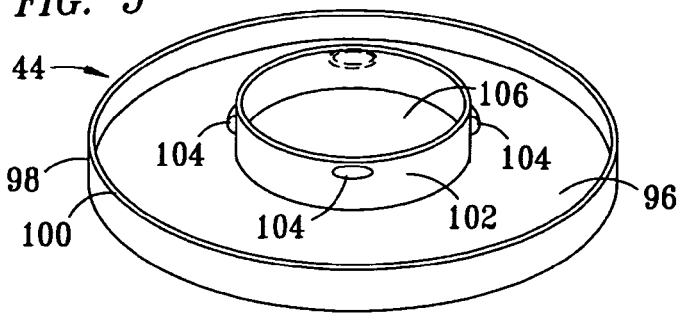

FIG. 5 is a perspective view of a canopy cover 44 for securing to the lower end 52 which defines a lower portion of the canopy 42. The cover 44 is mounted beneath the lower end 52 of the canopy 42 to conceal the mounting holes 56 and the clearance holes 58 from view beneath the ceiling fan 12. The canopy cover 44 has a disk portion 96 with an opening 106 which is preferably centrally disposed within the disk portion 96 for fitting around the down rod 32. A collar 102 is provided by a continuously extending member defining a wall portion which upwardly extends from the disk portion 96, adjacent to the opening 106. The collar 102 has a plurality of protuberances 104 which end outward from a side of the wall portion of the collar 102 which is opposite of the opening 106. The protuberances 104 are preferably provided by embosses formed into the collar 102 to define tabs for engaging an upper side of the lower end 52 of the canopy 42 in a snap engagement, providing an interlocking fit with the lower end of the canopy 42 to secure the cover 44 to the canopy 42. A lip portion 98 is defined by an outer sidewall which upwardly extends from an outer edge of the disk portion 96, spaced apart from the collar 102 and parallel with the collar 102. Preferably, the lip portion 98 and the collar 102 are of cylindrical shape and concentrically aligned. The lip portion 98 engages the underside of the lower end 52, providing a spacer having a thickness for locating the protuberances 104 in correct relation to the upperside of the lower end 52 for securing the cover 44 to the lower end 52 of the canopy 42.

Figure 6:
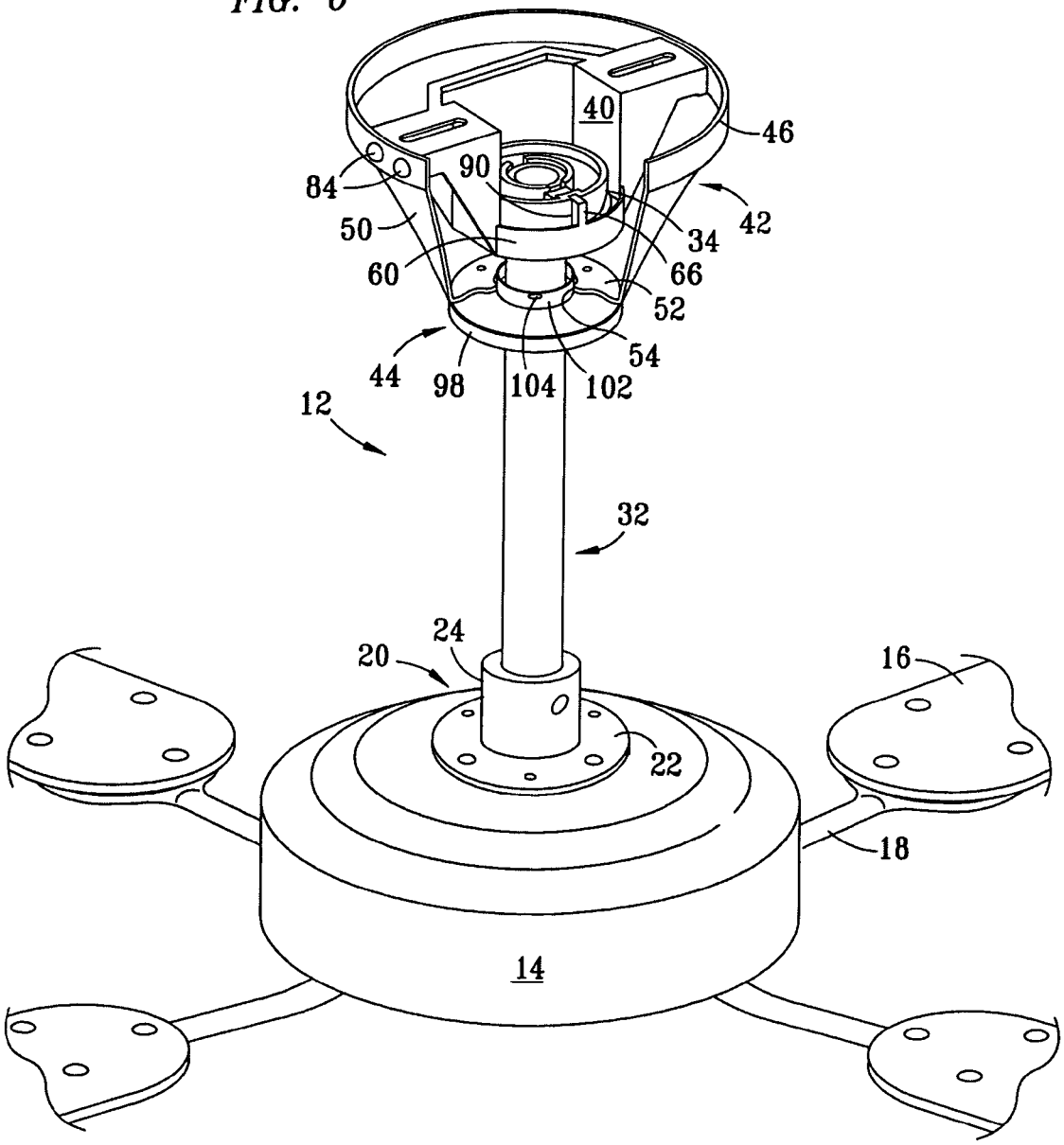

FIG. 6 is a perspective view of the ceiling fan 12 secured to a mounting bracket 40 by a down rod 32, with the canopy 42 shown in a one-quarter longitudinal sectional view. The canopy cover 44 is mounted to the lower end 52 of the canopy 42 to cover the apertures in the canopy 42, which are preferably defined by the mounting holes 56 and the clearance holes 58. The collar 102 has been passed into the down rod opening 54 in the lower end 52 until the lip 98 engages the lower end 52 and the protuberances 104 are extended above a portion of the lower end 52 adjacent the down rod hole 54 to secure the cover 44 to the canopy 42. The cover 44 may be removed from the canopy 42 by pulling the cover downward relative to the canopy 42, deforming the protuberances 104 to pass through the down rod opening 54.

The present invention provides a decorative canopy for concealing a mounting bracket which is fastened to a ceiling and suspends a ceiling fan from the ceiling. The canopy is preferably secured to the mounting bracket with threaded fasteners which extend through a rim portion of the upper end of the canopy. The canopy preferably has a lower end with apertures which provide mounting holes and clearance holes for passing fasteners which fit into the upper end of a motor housing of the ceiling fan when the motor housing is mounted directly to the canopy, when mounted in a configuration in which a down rod is note used. In other mounting configurations, the ceiling fan is suspended from the mounting bracket by means of a down rod. When securing the motor housing to the mounting bracket in the mounting configuration in which a down rod is used, a canopy cover is provided for mounting against a lower end of the canopy, to conceal the mounting holes and clearance holes which extend through the lower end of the canopy. The canopy cover has a disk portion with a centrally disposed opening for fitting around the down rod. A collar upwardly extends from the disk portion, adjacent to the opening. The collar has a plurality of protuberances which end outward of the opening for engaging an upper side of the lower end of the canopy, to interlock with the lower end and secure the canopy cover to the canopy in a snap engagement. A lip portion upwardly extends from an outer edge of the disk portion, spaced apart from the collar for engaging a lower side of the canopy to provide a spacer for locating the protuberances to extend adjacent the upper side of the lower end of the canopy.

Although the preferred embodiment has been described in detail, it should be understood that various changes, substitutions and alterations can be made therein without departing from the spirit and scope of the invention as defined by the appended claims.

What is claimed is:

1. An apparatus for mounting a ceiling fan, the apparatus comprising:

a mounting bracket having a support ring and two mounting arms, each of said mounting arms having a respective mounting aperture and an exteriorly disposed mounting portion;

a down rod having an upper end and a lower end, wherein said upper end of said down rod has a mounting boss which engages said support ring of said mounting bracket to suspend said ceiling fan from said mounting bracket, and said lower end of said down rod is adapted for engaging a mounting member of a motor housing of said ceiling fan;

a canopy having a rim portion, a sidewall and a lower portion which extend adjacent said mounting bracket, with said rim disposed adjacent said mounting portions of said mounting arms and secured to said mounting bracket, said lower portion having a down rod opening for receiving said down rod and apertures for securing said fan housing directly to said canopy in an alternate mounting configuration; and a cover having an opening for fitting around said down rod, said cover further having a collar which upwardly extends adjacent to said opening and which is sized for fitting in said down rod opening, with said collar having a plurality of protuberances which extend from said collar for engaging an upperside of said lower portion of said canopy to secure said collar to said canopy, said cover adapted for engaging said lower portion of said canopy for locating said protuberances to extend adjacent to said upper side of said lower portion of said canopy.

2. The apparatus according to claim 1, further comprising a lip portion which upwardly extends from an outward edge of said cover for engaging said lower portion of said canopy.

3. The apparatus according to claim 2, wherein said lip portion extends continuously around said outward edge of said cover, concentric with said opening.

4. The apparatus according to claim 1, wherein said collar extends continuously around said opening, adjacent to said opening.

5. The apparatus according to claim 1, wherein said protuberances are defined by embosses formed into said collar.

6. The apparatus according to claim 1, further comprising a lip portion which upwardly extends from an outward edge of said cover for engaging said lower portion of said canopy, wherein said collar is concentrically disposed within said lip portion.

7. The apparatus according to claim 1, further comprising a lip portion which upwardly extends from an outward edge of said cover, continuously around said outward edge of said cover, concentric with said opening; and wherein said collar extends continuously around said opening, adjacent to said opening, concentrically disposed within said lip portion.

8. The apparatus according to claim 7, wherein said cover is formed of metal and said protuberances are defined by embosses formed into said collar.

9. An apparatus for mounting a ceiling fan, the apparatus comprising:

a mounting bracket having a support ring and two mounting arms, each of said mounting arms having a respective mounting aperture and an exteriorly disposed face portion, with threaded mounting holes formed to extend into said exteriorly disposed face portions;

a down rod having an upper end and a lower end, wherein said upper end of said down rod has a mounting boss which engages said support ring of said mounting bracket to suspend said ceiling fan from said mounting bracket, and said lower end of said down rod is adapted for engaging a mounting member of a motor housing of said ceiling fan;

a canopy having a rim portion, a sidewall and a lower portion which extend adjacent said mounting bracket, said rim portion having mounting holes aligned for registering with said threaded mounting holes in said face portions of said mounting bracket, and said lower portion having a down rod opening for receiving said down rod and apertures for securing said fan housing directly to said canopy in an alternate mounting configuration; and a cover having a disk portion with an opening for fitting around said down rod, said cover further having a collar which upwardly extends from said disk portion, adjacent to said opening, with said collar sized for fitting in said down rod opening and having a plurality of protuberances which extend from said collar opposite said opening for engaging an upperside of said lower portion of said canopy to secure said collar to said canopy, said cover further having a spacer which upwardly extends from said disk portion and engages an underside of said lower portion of said canopy for locating said protuberances to extend adjacent said upper side of said lower portion of said canopy.

10. The apparatus according to claim 9, wherein said spacer upwardly extends from an outward edge of said disk portion.

11. The apparatus according to claim 10, wherein said spacer extends continuously around said outward edge of said disk portion, concentric with said opening.

12. The apparatus according to claim 9, wherein said collar extends continuously around said opening, adjacent to said opening.

13. The apparatus according to claim 12, wherein said protuberances are defined by embosses formed into said collar.

14. The apparatus according to claim 13, wherein said collar is concentrically disposed within said spacer.

15. The apparatus according to claim 9, wherein said spacer upwardly extends from an outward edge of said disk portion of said cover, continuously around said outward edge of said disk portion, concentric with said opening; and wherein said collar extends continuously around said opening, adjacent to said opening, concentrically disposed within said spacer.

16. An apparatus for mounting a ceiling fan, the apparatus comprising:

a mounting bracket having a support ring which is of annular shape, two mounting arms having lower portions which extend from opposite sides of said support ring, and a support arm which extends between upper portions of said two mounting arms, said support ring having two ends which are separated to define an opening in said support ring, wherein said opening in said support ring and said support arm are disposed on one side of said mounting arms, said mounting arms having gusset portions and tab portions, said tab portions defining said upper portions of said two mounting arms and each having a respective mounting aperture extending through said tab portions;

said tab portions defining two oppositely facing, exteriorly disposed face portion, with threaded mounting holes formed to extend into said exteriorly disposed face portions of said tab portions;

a down rod having an upper end and a lower end, wherein said upper end of said down rod has a mounting boss by which said down rod is suspended from said support ring of said mounting bracket, and said lower end of said down rod is adapted for securing to a motor housing of the ceiling fan;

a canopy having a rim portion, a sidewall and a lower portion which enclose said mounting bracket, said rim portion having mounting holes aligned for registering with said threaded mounting holes in said face portions of said mounting bracket, and said lower portion having an opening for receiving said down rod and apertures for securing said fan housing directly to said canopy in an alternate mounting configuration; and a cover having a disk portion with a centrally disposed opening for fitting around said down rod, said cover further having a collar which upwardly extends from said disk portion, adjacent to said opening, with said collar having a plurality of protuberances which extend from said collar opposite said opening for engaging an upper side of said lower portion of said canopy to secure said collar to said canopy, said cover further having a lip portion which upwardly extends from an outer edge of the disk portion and engages a lower side of said lower portion of said canopy to provide a spacer for locating said protuberances to extend adjacent said upper side of said lower portion of said canopy.

17. The apparatus according to claim 16, wherein said lip portion upwardly extends from an outward edge of said disk portion, continuously around said outward edge of said disk portion, concentric with said opening.

18. The apparatus according to claim 17, wherein said collar extends continuously around said opening, adjacent to said opening.

19. The apparatus according to claim 18, wherein said collar is concentrically disposed within said lip portion.

20. The apparatus according to claim 19, wherein said protuberances are defined by embosses formed into said collar.

* * * * *